US005588229A

United States Patent [19]

Marmonier

[11] Patent Number: 5,588,229

[45] Date of Patent: Dec. 31, 1996

[54] SKI BOOT

[75] Inventor: Gilles Marmonier, Saint Etienne de Crossey, France

[73] Assignee: Lange International S.A., Fribourg, Switzerland

[21] Appl. No.: 605,453

[22] Filed: Feb. 26, 1996

Related U.S. Application Data

[63] Continuation of Ser. No. 205,581, Mar. 3, 1994, abandoned.

[30] Foreign Application Priority Data

Apr. 2, 1993 [CH] Switzerland ..... 01026/93

[51] Int. Cl.[6] ..... A43B 5/04

[52] U.S. Cl. ..... 36/118.9; 36/118.2

[58] Field of Search ..... 36/117–121, 50.5

[56] References Cited

U.S. PATENT DOCUMENTS

| | | | |
|---|---|---|---|
| 4,499,676 | 2/1985 | Chalmers, II | 36/117 X |
| 4,839,973 | 6/1989 | Dodge | 36/121 |
| 4,899,469 | 2/1990 | Hilgarth | 36/121 X |
| 5,031,341 | 7/1991 | Paris et al. | 36/120 X |

FOREIGN PATENT DOCUMENTS

| | | | |
|---|---|---|---|
| 0502795 | 9/1992 | European Pat. Off. . | |
| 2454767 | 11/1980 | France | 36/50.5 |
| 2648327 | 12/1990 | France . | |
| 2647649 | 12/1990 | France . | |
| 2656989 | 7/1991 | France . | |
| 2654903 | 4/1992 | France . | |
| 4224562 | 1/1993 | Germany . | |

OTHER PUBLICATIONS

International Search Report of Swiss 1026/93.

*Primary Examiner*—Ted Kavanaugh
*Attorney, Agent, or Firm*—Kane, Dalsimer, Sullivan, Kurucz, Levy, Eisele and Richard, LLP

[57] ABSTRACT

Ski boot comprising a shell (1) and a shaft (3) articulated on the shell, the shaft consisting of a first part (5) forming a stirrup (6) extending around and above the heel, and a second part (7) surrounding at least the rear of the leg. These two parts may be fixed together with respect to rotation by connecting structure consisting of a rocker (9) articulated on the second part so as to be able to bear on the stirrup (6). The rocker may also enable the shaft to be locked onto the shell in the downhill position.

5 Claims, 2 Drawing Sheets

SKI BOOT

This application is a continuation of application Ser. No. 08/205,581, filed Mar. 3, 1994, now abandoned.

FIELD OF THE INVENTION

The present invention relates to a ski boot comprising a shell intended to surround the foot and the heel and a shaft articulated on the shell and consisting of two parts, namely a first part forming a stirrup extending around and above the heel and a second part surrounding at least the rear of the leg, these two parts being able to be fixed to each other with respect to rotation by connecting means, at least in the closed position of the shaft.

PRIOR ART

From the U.S. Pat. No. 5,243,774 a boot is known, the shaft of which consists of a first part in the form of a collar having a large opening at the rear leaving a bridge in the form of a stirrup extending around and above the heel, and a second part in the form of a rear cap closing off the opening like a box lid. The two parts of the shaft are held together, in the closed position, by a buckle.

From the patent FR 2 654 903, a ski boot is also known, the shaft of which, in the form of a collar, is articulated not directly on the shell but on a stirrup, which is itself articulated on the shell.

From the U.S. Pat. No. 4,499,676 a boot is also known, the shaft of which, in the form of a collar, is provided at the rear with a catch interacting with a stop formed on the shell to hold the shaft, as desired, in the downhill position.

The invention proposes to fix the two parts of the shaft together with respect to rotation by means different from those proposed up till now and offering other possibilities of use.

SUMMARY OF THE INVENTION

The boot according to the invention is characterized in that the said connecting means consist of a catch or rocker articulated at the rear of the second part of the shaft so as to be able to bear on the stirrup.

These connecting means may be used alone or in combination with a buckle.

The position of the catch also enables it to be used at the same time to lock the shaft in the downhill position. For this purpose, the catch may have two beaks, one of which moves away from the stop formed on the shell before the other beak moves away from the stirrup, which enables the shaft to tilt on the shell while keeping the shaft closed, that is to say to move from the downhill position to a walking position.

Another possibility consists of using a catch, the active end of which is sufficiently wide to come into abutment both against the boot stop and on the stirrup. When the catch is moved away from the shell, its beak first of all moves away from the stop on the shell while continuing to bear on the stirrup.

The catch can replace any other means for closing the two parts of the shaft if these parts have sufficient rigidity.

BRIEF DESCRIPTION OF THE DRAWINGS

The accompanying drawing shows, by way of example, some embodiments of the invention.

DESCRIPTION OF THE PREFERRED EMBODIMENTS

Figure 1:
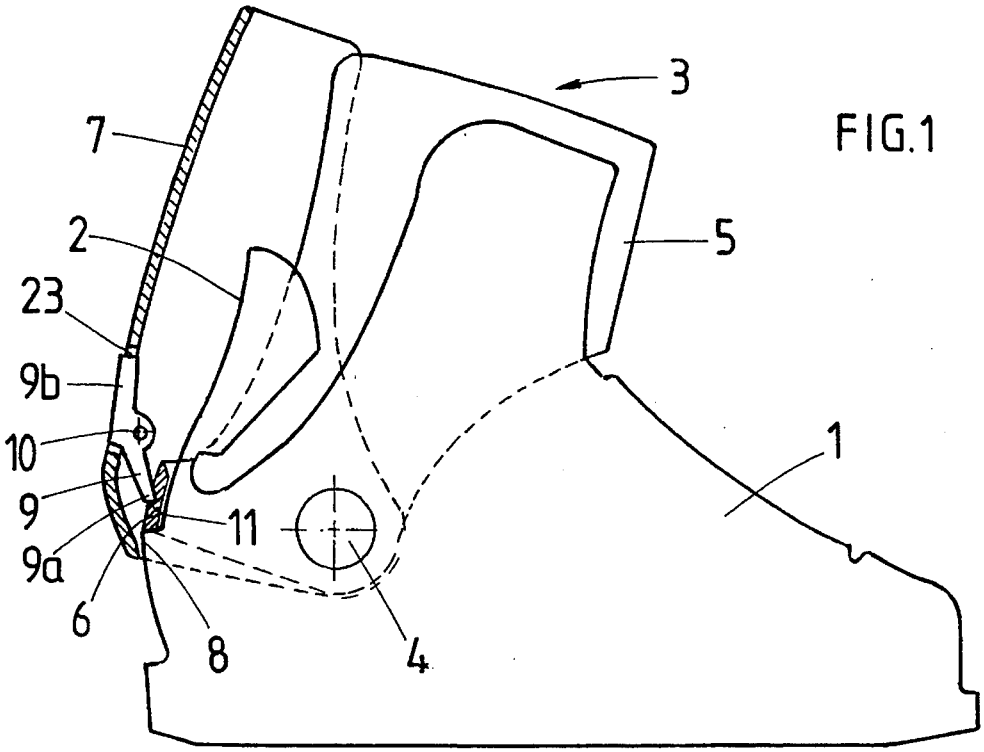
FIG. 1 is a diagrammatic view of a ski boot showing a first embodiment of a connecting catch between the two parts of the shaft.

The boot shown diagrammatically in FIG. 1 comprises a variable-volume shell 1 surrounding the foot and heel and provided, at the rear, with a tongue 2. Such a shell is described for example in the patent EP 0 286 586. A shaft 3 is articulated on this shell by means of rivets 4. This shaft 3 consists of a first part 5 in the form of a collar having a deep, wide indentation at the rear leaving a stirrup 6 extending around and above the heel, and a second part 7, also articulated at 4, in the form of a cap closing off the rear indentation on the first part 5 by bearing edge-to-edge on the edges of this indentation, as described in the patent FR 2 673 081. The shell 1 has at the rear a stop 8 against which the stirrup 6 bears. In the lower part of the part 7 in the form of a cap is mounted a catch or rocker 9 articulated about a horizontal axis 10. In the closed position of the boot, shown in the drawing, the beak **9*a* of the catch 9 is engaged in a notch 11 formed in the stirrup 6. This notch 11 has a substantially horizontal face against which bears the front face of the beak 9*a*. The catch 9 is held in this position by a spring, for example a coil spring surrounding the axis 10. To disengage the catch from the stirrup 6, it suffices to exert pressure on the upper arm 9*b* of the catch, accessible through a cutout 23 in the cap 7**.

In the position shown, the catch 9 holds the two parts 5 and 7 of the shaft in the closed position. Pressing on the arm **9*b* of the catch enables the cap 7** to be tilted backwards in order to put on and remove the boot.

Figure 2:
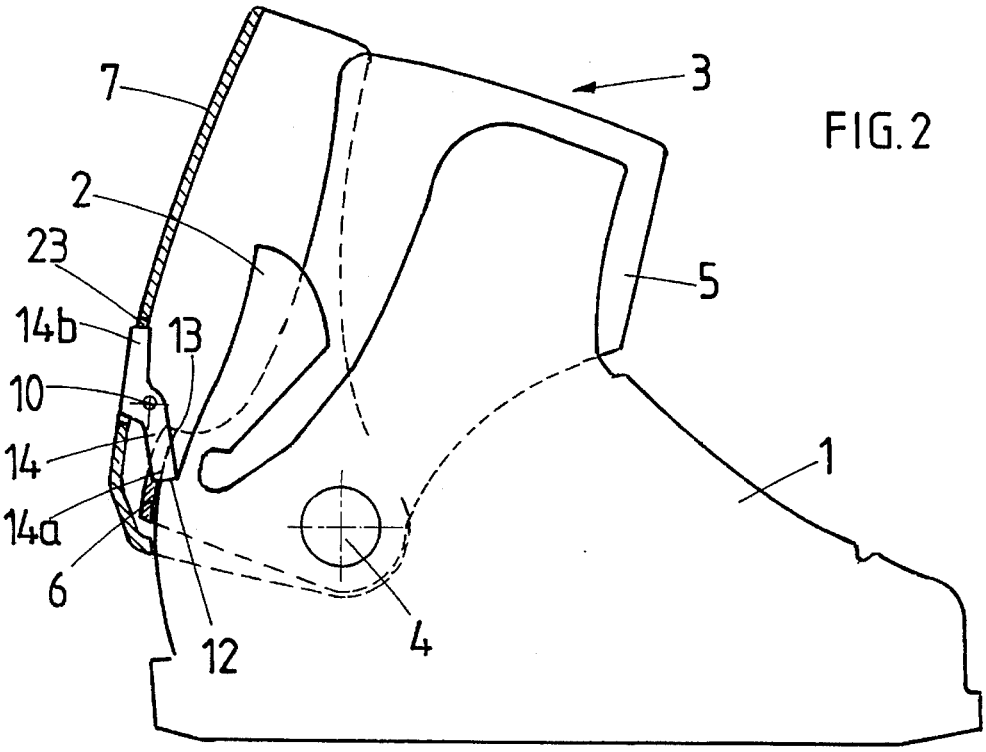
FIG. 2 is a similar view to the one in FIG. 1, illustrating a second embodiment of the connecting catch.

The boot shown in FIG. 2 has a shell 1 and a shaft 3 analogous to those of the boot shown in FIG. 1. The shell is however different because of the presence of a rear stop 12 formed higher up than the stop 8 in FIG. 1 and sloping at a different angle. The shaft 3 of this boot is also formed from parts 5 and 7, but the stirrup 6 here has a vertical notch 13, in which engages a catch or rocker 14 analogous to the catch 9 and articulated in the same way about an axis 10. The beak **14*a* of this catch has a width such that, as seen in the plane of the drawing, it can bear both against the stop 12 and against the back of the notch 13 in the stirrup, as can be seen in the drawing. In this case, the stirrup 6 does not bear against the stop 12 on the shell, the shaft 3 being locked in the downhill position by the catch 14. If, in the position shown in the drawing, pressure is exerted on the arm 14*b* of the catch, the latter, in a first stage of its pivoting, first moves away from the stop 12 on the shell while nevertheless continuing to bear on the stirrup 6. The shaft can thus straighten up by pivoting backwards about its articulation 4 while remaining closed. A relaxation or walking position is thus obtained. If pressure continues to be exerted on the arm 14*b* of the catch, the latter then moves away from the stirrup 6, enabling the shaft 3 to be opened by the tilting of the cap 7** towards the rear.

The three specific positions of the catch 14 may be provided, for example, by latching directly between the arm **14*b* and the part 7 of the shaft or by an auxiliary cam mounted on the part 7 and acting on the arm 14***b*. This cam may be actuatable in rotation or in translation. Two of the specific positions of the cam may be provided by stops and the third, intermediate, position by a notch or tight spot.

Figure 3:
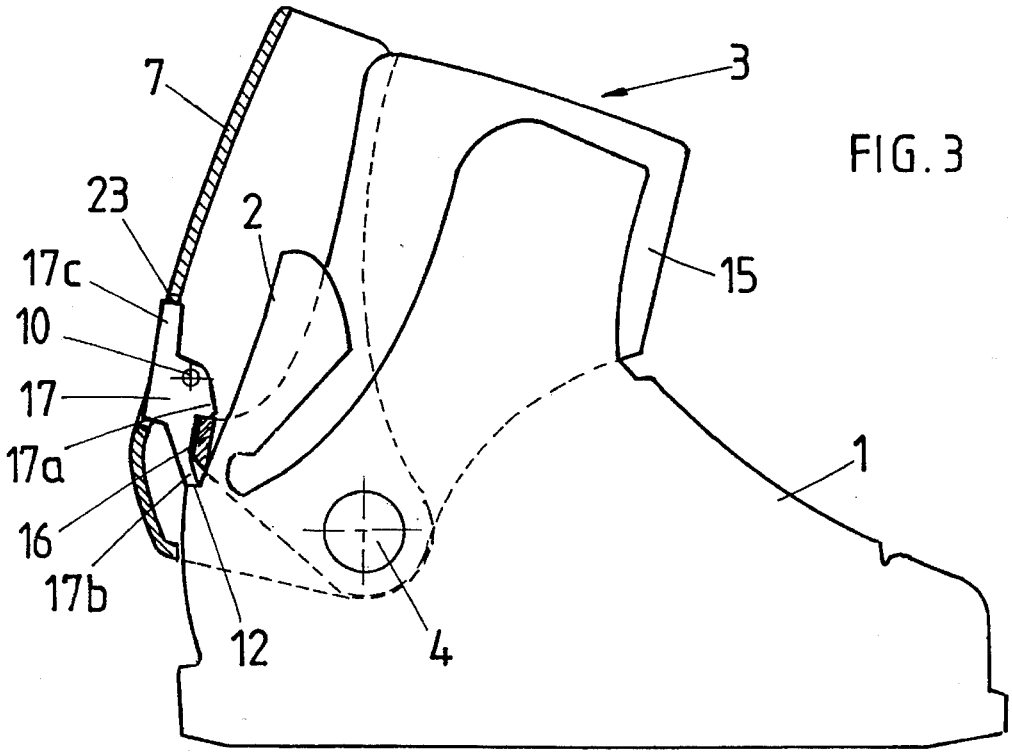
FIG. 3 is a similar view to the one in FIG. 1, illustrating a third embodiment of the connecting catch.

The boot shown in FIG. 3 comprises a shell 1 identical to that of the second embodiment shown in FIG. 2. The shaft of the boot consists of a part in the form of a collar 15 similar to the collar 5 of the previous embodiments and the rear indentation in which also leaves a stirrup 16 lying above the heel. This stirrup 16 is in this case located slightly above the stop 12 on the shell so as to leave a space between the lower edge of the stirrup 16 and the stop 12. The back part 7 of the shaft is also provided with a catch or rocker 17 articulated about a horizontal axis 10. This catch 17 has two beaks 17*a* and 17*b* situated at different distances from the axis 10, the beak 17*b* being slightly more than twice as far from the axis 10 as the beak 17*a*.

In the position shown in the drawing, the beak 17*a* bears on the stirrup 16 and the beak 17*b* against the stop 12 on the shell. If pressure is exerted on the upper arm 17*c* of the catch 17, the beak 17*b* initially moves away from the stop 12, the length of the arc which it describes during the rotation of the catch being appreciably greater than the length of the arc described by the beak 17*a* which continues to bear on the upper edge of the stirrup 16. The shaft 3 therefore remains closed but is able to straighten up by pivoting about its articulation 4 until the lower edge of the stirrup 16 comes up against the stop 12 on the shell. The straightening of the shaft is therefore limited in this case.

If further pressure is exerted on the arm 17*c* of the catch, its beak 17*a* moves away from the stirrup 16, enabling the shaft 3 to be opened by the tilting backwards of its part 7. The different positions of the catch 7 can be provided as in the previous embodiment.

Figure 4:
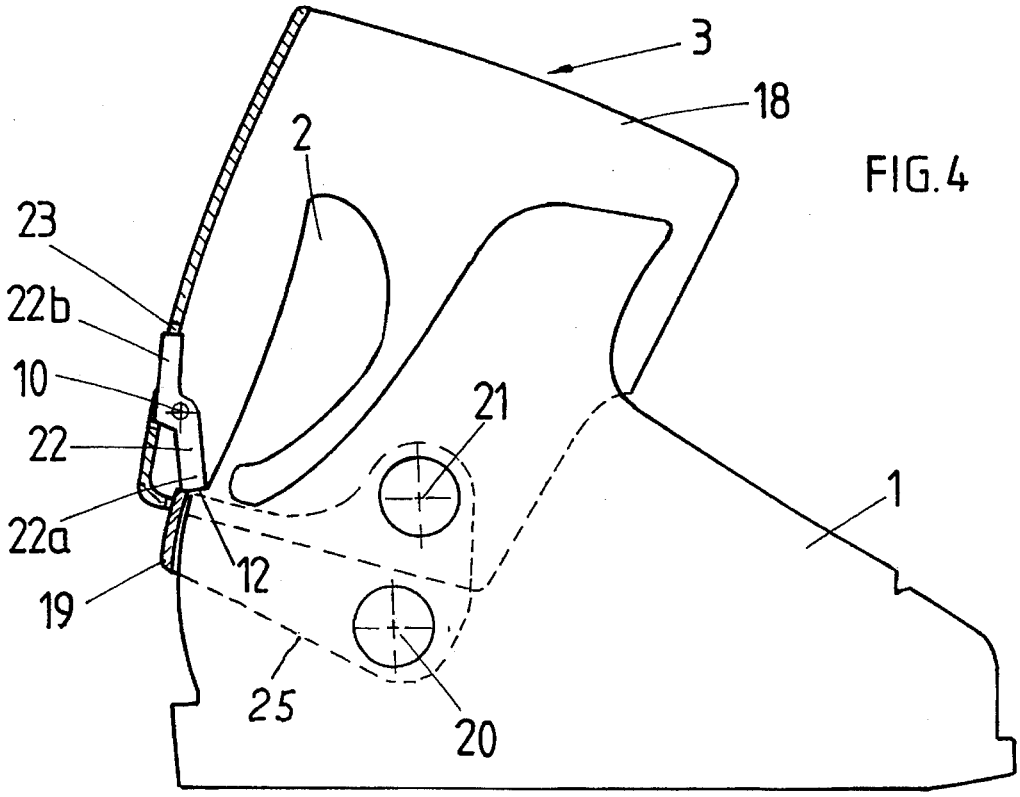
FIG. 4 shows diagrammatically a fourth embodiment.

The boot shown in FIG. 4 comprises a shell 1 similar to the one in the previous embodiment. On this shell 1 is mounted a shaft 3', consisting firstly of a collar 18, provided at the front with at least one tightening buckle (not shown), and secondly a part 25 forming a stirrup 19 extending around and above the heel part of the shell 1. The collar 18 is articulated not directly on the shell 1 but on the part 25, by means of rivets 21, the part 25 being itself articulated on the shell 1 by means of rivets 20. In the rear part of the collar 18 a catch or rocker 22 is mounted, similar to the catch 14 in FIG. 2 and, like it, articulated about an axis 10. This catch 22, like the catch 14, has a wide beak 22*a* against which the upper edge of the stirrup 19 comes to bear when this beak bears against the stop 12 on the shell 1. This catch 22 has an actuating arm 22*b* accessible through a cutout 23 in the collar 18.

In the position shown in the drawing, the catch 22 is in abutment both against the stop 12 on the shell and against the upper edge of the stirrup 19, so that the collar 18 is held in the downhill position, sloping slightly forwards. By exerting pressure on the arm 22*b* of the catch, it is possible, in a first stage, to disengage the catch from the stop 12 while keeping the catch in abutment on the stirrup 19. The collar 18 and stirrup 19 remain fixed to each other, but the assembly may be straightened up by pivoting about the articulation 20. A relaxation or walking position is thus obtained. If the arm 22*b* is pressed in further, the beak 22*a* of the catch leaves the edge of the stirrup 19, so that the collar 18, provided that its tightening buckles are open, may be tilted backwards about its articulation 21 on the stirrup 19 so as to facilitate the putting on and removal of the boot.

The various positions of the catch 22 may be provided in the same way as in the second and third embodiments.

I claim:

1. A ski boot having a front and a back end for a skier's foot, heel and leg, comprising: a rear having a shell (1) intended to surround the foot and the heel, a shaft (3; 3') having a closed position and being articulated on the shell and being comprised of two parts, namely a first part (5; 15; 25) forming a stirrup (6; 16; 19) having an upper edge and extending around and above the heel and a second part having a rear end (7, 18) surrounding at least the rear of the leg, these two parts being able to be fixed to each other with respect to rotation by connecting means, at least in the closed position of the shaft, wherein the said connecting means consist of a rocker (9; 14; 17; 22) having an axis and end and being articulated on the rear of the second part of the shaft so as to be able to bear on and engage the stirrup, said rocker including at least one beak movable to a (1) first position wherein said beak bears and engages the stirrup and maintains the stirrup integral in backwards rotation with said second part, whereby rotation of the second part relative to the first part is prevented to define the closed position of the shaft and (2) a second position wherein said beak is disengaged from the stirrup and said second part can rotate backwards independently from the stirrup, whereby the second part is adapted to tilt backwards to formulate putting on and removal of the boot.

2. The ski boot as claimed in claim 1, the shaft of which is equipped, at the rear, with means for locking the shaft in a downhill position at which the shaft is tilted forwardly, these means comprising a stop (12) formed on the shell.

3. The ski boot as claimed in claim 2, wherein the stirrup (16) lies above the stop (12) on the shell and the rocker (17) has two beaks (17*a*, 17*b*) situated at different distances from the axis of the rocker, one (17*a*) of these beaks bearing against the upper edge of the stirrup and the other beak (17*b*) bearing against the stop (12) on the shell so that, when the rocker pivots away from its locked position, the rocker first of all moves away from the stop on the shell, and then from the stirrup.

4. The ski boot as claimed in claim 2, wherein the end (14*a*; 22*a*) of the rocker (14; 22) has a thickness such that in the locked position it bears both against the stop (12) on the shell and against the upper edge of the stirrup (6; 19), so that when pivoting away from its locked position it first moves away from the stop on the shell and then from the upper edge of the stirrup.

5. A ski boot having a front and a back end for a skier's foot, heel and leg, comprising: a rear having a shell (1) intended to surround the foot and the heel, a shaft (3; 3') having a close position and being articulated on the shell and being comprised of two parts, namely a first part (5; 15; 25) forming a stirrup (6; 16; 19) having an upper edge and extending around and above the heel and a second part having a rear end (7, 18) surrounding at least the rear of the leg, these two parts being able to be fixed to each other with respect to rotation by connecting means, at least in the closed position of the shaft, wherein the said connecting means consist of a rocker (9; 14; 17; 22) having an axis and end and being articulated on the rear of the second part of the shaft so as to be able to bear on and engage the stirrup to interlock the second part with the stirrup and to prevent rotation of the second part relative to the first part to define the closed position of the shaft and when the rocker is disengaged from the stirrup the second part is adapted to tilt backwards to formulate putting on and removal of the boot, the shaft of which is equipped, at the rear, with means for locking the shaft in a downhill position at which the shaft is tilted forwardly, these means comprising firstly a stop (12) formed on the shell and secondly a rocker articulated on the second part of the shaft, wherein the rocker for locking the shaft on the shell is the same as the rocker (14; 17; 22) fixing the two parts of the shaft together, the stirrup (16) lies above the stop (12) of the shell and the rocker (17) has two beaks (17*a*, 17*b*) situated at different distances from the axis of the rocker, one (17*a*) of these beaks bearing against the upper edge of the stirrup and the other beak (17*b*) bearing against the stop (12) on the shell so that, when the rocker pivots away from its locked position, the rocker first of all moves away from the stop on the shell, and then from the stirrup.

* * * * *